US009967928B2

(12) United States Patent
Harris

(10) Patent No.: US 9,967,928 B2
(45) Date of Patent: May 8, 2018

(54) REPLACEABLE LIGHTING FIXTURE COMPONENTS

(71) Applicant: Cree, Inc., Durham, NC (US)

(72) Inventor: Michael James Harris, Cary, NC (US)

(73) Assignee: Cree, Inc., Durham, NC (US)

( * ) Notice: Subject to any disclaimer, the term of this patent is extended or adjusted under 35 U.S.C. 154(b) by 440 days.

(21) Appl. No.: 13/800,656

(22) Filed: Mar. 13, 2013

(65) Prior Publication Data

US 2014/0265930 A1 Sep. 18, 2014

(51) Int. Cl.
*H05B 33/08* (2006.01)
*F21V 23/00* (2015.01)
(Continued)

(52) U.S. Cl.
CPC ..... *H05B 33/0809* (2013.01); *H05B 33/0842* (2013.01); *F21S 8/026* (2013.01); *F21V 7/0008* (2013.01); *F21V 23/008* (2013.01); *F21V 23/0464* (2013.01); *F21Y 2103/10* (2016.08); *F21Y 2115/10* (2016.08)

(58) Field of Classification Search
CPC ..... H05B 33/0842; H05B 33/0803; H05B 37/0254; H05B 37/0263; H05B 33/0851; H05B 33/0896; H05B 37/0245; H05B 33/0866; G05B 15/02; F21V 21/096; F21S 8/035; F21S 2/005; Y02B 20/383;
(Continued)

(56) References Cited

U.S. PATENT DOCUMENTS 1,099,061 A 6/1914 Lane
6,528,954 B1 3/2003 Lys et al.
(Continued)

FOREIGN PATENT DOCUMENTS

EP 2213932 A1 8/2010
WO 03055273 A2 7/2003
(Continued)

OTHER PUBLICATIONS

International Search Report and Written Opinion for PCT/US2013/058256, dated Dec. 17, 2013, 9 pages.
(Continued)

*Primary Examiner* — Alexander H Taningco
*Assistant Examiner* — Renan Luque
(74) *Attorney, Agent, or Firm* — Withrow & Terranova, P.L.L.C.

(57) ABSTRACT

A lighting fixture includes a driver module and a separate light engine module, which has a solid-state light source and light engine memory. The driver module is electrically coupled to the light engine module and configured to drive the solid-state light source based on drive data. The drive data defines how the driver module should drive the solid-state light source to generate light with at least one defined lighting characteristic. The drive data may define or be used to identify the signal characteristics, such as drive currents, voltages, waveforms, and the like that must be provided by the driver module to drive the solid-state light source. The drive data is stored in the light engine memory of the light engine module, and the driver module is configured to retrieve the drive data from the light engine memory and drive the solid-state light source based on the drive data.

25 Claims, 12 Drawing Sheets

(51) Int. Cl.

| | |
|---|---|
| ***F21V 7/00*** | (2006.01) |
| ***F21S 8/02*** | (2006.01) |
| ***F21V 23/04*** | (2006.01) |
| *F21Y 103/10* | (2016.01) |
| *F21Y 115/10* | (2016.01) |

(58) Field of Classification Search

CPC ..... Y10T 307/944; F21Y 2101/00; F21Y 2105/10; F21K 2101/00; F21K 2105/10

USPC ..... 315/291, 294, 312

See application file for complete search history.

(56) References Cited

U.S. PATENT DOCUMENTS

| | | | | |
|---|---|---|---|---|
| 6,948,829 | B2 | 9/2005 | Verdes et al. | |
| 7,187,136 | B2 | 3/2007 | Fiorello | |
| 7,396,146 | B2 | 7/2008 | Wang | |
| 7,549,772 | B2 | 6/2009 | Wang | |
| 7,550,931 | B2 * | 6/2009 | Lys | A01M 1/04 315/291 |
| 7,677,767 | B2 | 3/2010 | Chyn | |
| 7,888,881 | B2 | 2/2011 | Shteynberg et al. | |
| 8,466,628 | B2 | 6/2013 | Shearer et al. | |
| 8,581,499 | B2 * | 11/2013 | Fries | B61L 5/189 315/129 |
| 8,610,377 | B2 | 12/2013 | Chemel et al. | |
| 8,686,646 | B2 * | 4/2014 | Tanaka | H05B 33/0863 315/152 |
| 8,829,800 | B2 | 9/2014 | Harris | |
| 9,232,607 | B2 * | 1/2016 | Chitta | H05B 41/295 |
| 9,693,402 | B2 * | 6/2017 | Zimmermann | H05B 33/08 |
| 2005/0111234 | A1 | 5/2005 | Martin et al. | |
| 2006/0044152 | A1 * | 3/2006 | Wang | 340/825 |
| 2007/0013557 | A1 | 1/2007 | Wang et al. | |
| 2007/0024213 | A1 | 2/2007 | Shteynberg et al. | |
| 2007/0132405 | A1 | 6/2007 | Hillis et al. | |
| 2008/0158887 | A1 | 7/2008 | Zhu et al. | |
| 2009/0021955 | A1 | 1/2009 | Kuang et al. | |
| 2009/0086492 | A1 | 4/2009 | Meyer | |
| 2009/0219727 | A1 | 9/2009 | Weaver | |
| 2009/0237011 | A1 * | 9/2009 | Shah | H05B 33/0803 315/312 |
| 2009/0267540 | A1 | 10/2009 | Chemel et al. | |
| 2010/0110699 | A1 | 5/2010 | Chou | |
| 2010/0177509 | A1 | 7/2010 | Pickard | |
| 2010/0201274 | A1 * | 8/2010 | Deixler | 315/152 |
| 2010/0296285 | A1 * | 11/2010 | Chemel | F21S 2/005 362/235 |
| 2011/0006604 | A1 | 1/2011 | Chang et al. | |
| 2011/0095706 | A1 * | 4/2011 | Vilmi | H05B 33/0851 315/294 |
| 2011/0095709 | A1 | 4/2011 | Diehl et al. | |
| 2011/0101868 | A1 * | 5/2011 | Weiss | H05B 37/0245 315/130 |
| 2011/0204816 | A1 * | 8/2011 | Policy | H05B 37/0254 315/294 |
| 2011/0248640 | A1 | 10/2011 | Welten | |
| 2012/0043912 | A1 | 2/2012 | Huynh et al. | |
| 2012/0119661 | A1 * | 5/2012 | Muller | F21K 9/00 315/158 |
| 2012/0162980 | A1 * | 6/2012 | Mrakovich | 362/235 |
| 2012/0187845 | A1 * | 7/2012 | Saes | H05B 33/0818 315/113 |
| 2012/0229041 | A1 | 9/2012 | Saes et al. | |
| 2013/0033872 | A1 | 2/2013 | Randolph et al. | |
| 2013/0257292 | A1 | 10/2013 | Verfuerth et al. | |
| 2014/0001962 | A1 | 1/2014 | Harris | |

FOREIGN PATENT DOCUMENTS

| | | | |
|---|---|---|---|
| WO | 2008059445 | A2 | 5/2008 |
| WO | 2011070058 | A2 | 6/2011 |
| WO | 2011087681 | A1 | 7/2011 |
| WO | WO2011/087681 | * | 7/2011 |

OTHER PUBLICATIONS

International Search Report and Written Opinion for PCTJUS2014/023887, dated Jun. 13, 2014, 7 pages.
International Search Report for PCT/US2012/067754 dated Feb. 20, 2013, 11 pages.
International Preliminary Report on Patentability for PCT/US2012/067754, dated Jun. 19, 2014, 8 pages.
International Search Report and Written Opinion for PCT/US2013/047602, dated Oct. 11, 2013, 13 pages.
Notice of Allowance for U.S. Appl. No. 13/606,713 dated May 2, 2014, 7 pages.
Non-Final Office Action for U.S. Appl. No. 13/589,899, dated Apr. 2, 2014, 15 pages.
Final Office Action for U.S. Appl. No. 13/649,531, dated Dec. 16, 2014, 7 pages.
Non-final Office Action for U.S. Appl. No. 13/649,531, dated Jul. 31, 2014, 7 pages.
International Preliminary Report on Patentability for PCT/US2013/047602, dated Jan. 15, 2015, 10 pages.
International Preliminary Report on Patentability for PCT/US2014/023887, dated Sep. 24, 2015, 5 pages.
Examination Report for German Patent Application No. 112012005131.9, dated Aug. 5, 2015, 18 pages.
Final Office Action for U.S. Appl. No. 13/649,531, dated Oct. 8, 2015, 8 pages.
Final Office Action for U.S. Appl. No. 13/589,899, dated Nov. 6, 2015, 12 pages.
International Preliminary Report on Patentability for PCT/US2013/058256, dated Mar. 19, 2015, 7 pages.
Non-Final Office Action for U.S. Appl. No. 13/589,899, dated Apr. 20, 2015, 12 pages.
Non-Final Office Action for U.S. Appl. No. 13/649,531, dated Jun. 4, 2015, 9 pages.
Advisory Action for U.S. Appl. No. 13/649,531, dated Dec. 24, 2015, 3 pages.
Notification of Refusal for German Patent Application No. 112012005131.9, dated Apr. 11, 2016, 13 pages.
Advisory Action for U.S. Appl. No. 13/589,899, dated Feb. 11, 2016, 3 pages.
Examination Report for European Patent Application No. 14723531.1, dated Mar. 14, 2016, 5 pages.
First Office Action for Chinese Patent Application No. 201380045126.4, dated Feb. 1, 2016, 20 pages.
Non-Final Office Action for U.S. Appl. No. 13/589,899, dated May 5, 2016, 11 pages.
Examination Report for European Patent Application No. 13762691.7, dated Dec. 6, 2016, 5 pages.
Examination Report for European Patent Application No. 14723531.1, dated Jan. 4, 2017, 4 pages.
Examiner's Answer to the Appeal Brief for U.S. Appl. No. 13/649,531, dated Sep. 8, 2016, 7 pages.
Non-Final Office Action for U.S. Appl. No. 13/589,899, dated Nov. 2, 2016, 13 pages.
Final Office Action for U.S. Appl. No. 13/589,899, dated May 8, 2017, 13 pages.
Examination Report for European Patent Application No. 13762691.7, dated Jun. 2, 2017, 3 pages.
Examination Report for European Patent Application No. 14723531.1, dated Jul. 12, 2017, 4 pages.
Non-Final Office Action for U.S. Appl. No. 13/589,899, dated Oct. 6, 2017, 14 pages.
Examination Report for European Patent Application No. 13762691.7, dated Dec. 1, 2017, 6 pages.
Examination Report for European Patent Application No. 13735151.6, dated Oct. 6, 2017, 8 pages.
Decision on Appeal for U.S. Appl. No. 13/649,531, dated Nov. 6, 2017, 7 pages.

* cited by examiner

REPLACEABLE LIGHTING FIXTURE COMPONENTS

FIELD OF THE DISCLOSURE

The present disclosure relates to lighting fixtures, and in particular to providing replaceable components for lighting fixtures.

BACKGROUND

In recent years, a movement has gained traction to replace incandescent light bulbs with lighting fixtures that employ more efficient lighting technologies as well as to replace relatively efficient fluorescent lighting fixtures with lighting technologies that produce a more pleasing, natural light. One such technology that shows tremendous promise employs light emitting diodes (LEDs). Compared with incandescent bulbs, LED-based light fixtures are much more efficient at converting electrical energy into light, are longer lasting, and are also capable of producing light that is very natural. Compared with fluorescent lighting, LED-based fixtures are also very efficient, but are capable of producing light that is much more natural and more capable of accurately rendering colors. As a result, lighting fixtures that employ LED technologies are expected to replace incandescent and fluorescent bulbs in residential, commercial, and industrial applications.

Unlike incandescent bulbs that operate by subjecting a filament to a desired current, LED-based lighting fixtures require electronics to drive one or more LEDs. The electronics generally include a power supply and special control circuitry to provide uniquely configured signals that are required to drive the one or more LEDs in a desired fashion. For a given lighting fixture, the control circuitry and the LEDs are paired together during manufacturing and are calibrated to ensure that the lighting fixture is able to provide light at a desired color, color temperature, brightness, or the like.

SUMMARY

The present disclosure relates to a lighting fixture that includes a driver module and a separate light engine module, which has a solid-state light source and light engine memory. The driver module is electrically coupled to the light engine module and is configured to drive the solid-state light source based on drive data. The drive data effectively defines how the driver module should drive the solid-state light source to generate light with at least one defined lighting characteristic, such as intensity (or brightness), color, color temperature, and the like. The drive data may define or be used to identify the signal characteristics, such as drive currents, voltages, waveforms, and the like that must be provided by the driver module to drive the solid-state light source. Notably, the drive data is stored in the light engine memory of the light engine module, and the driver module is configured to retrieve the drive data from the light engine memory and drive the solid-state light source based on the drive data.

In one embodiment, the driver module, the light engine module, or both are readily replaceable in the field. Given the inherent tolerances in solid-state light sources, such as LEDs, the solid-state light sources in different light engine modules will typically require different drive data to achieve light with the defined characteristic(s). Storing the unique drive data for a given solid-state light source in the associated light engine memory of the light engine module allows the driver module to which the light engine module is ultimately connected to access and use the proper drive data to drive the solid-state light source of the light engine module.

For example, assume an original light engine module is replaced with a new light engine module in a lighting fixture. In this instance, the original driver module can access the new drive data from the light engine memory of the new light engine module and then use the new drive data to drive the solid-state light source of the new light engine module. If an original driver module is replaced with a new driver module in a lighting fixture, the new driver module can access the original drive data from the light engine memory of the original light engine module and then use the original drive data to drive the solid-state light source of the original light engine module.

In one embodiment, the driver module may have local memory and store the drive data that is accessed from the light engine memory of the light engine module in the local memory. During normal operation, the driver module will access the drive data from the local memory when determining how to drive the solid-state light source of the light engine module. The driver module may look at pairing data in the local memory or in the light engine memory to determine whether a different light engine module has been paired with the driver module and new drive data should be accessed from the light engine memory. Further, the light engine memory may also include light engine data, such as product information, identification information, and the like for the light engine module. The light engine data may be accessed, stored in local memory, and used by the driver module.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

Figure 1:
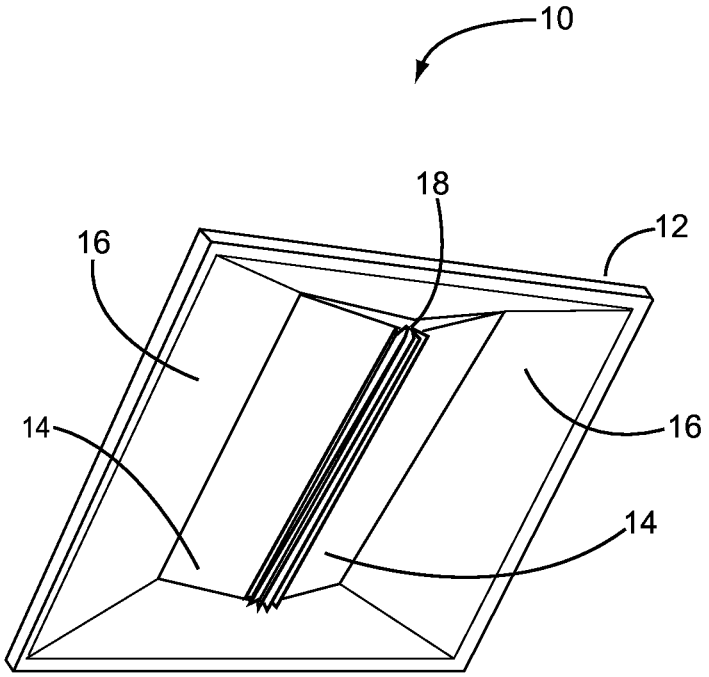
FIG. 1 is a perspective view of a troffer-based lighting fixture according to one embodiment of the disclosure.

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

The present disclosure relates to a lighting fixture that includes a driver module and a separate light engine module, which has a solid-state light source and light engine memory. The driver module is electrically coupled to the light engine module and configured to drive the solid-state light source based on drive data. The drive data effectively defines how the driver module should drive the solid-state light source to generate light with at least one defined lighting characteristic, such as intensity (or brightness), color, color temperature, and the like. The drive data may define or be used to identify the drive currents, voltages, waveforms, and the like that must be provided by the driver module to drive the solid-state light source. Notably, the drive data is stored in the light engine memory of the light engine module, and the driver module is configured to retrieve the drive data from the light engine memory and drive the solid-state light source based on the drive data.

In one embodiment, the driver module, the light engine module, or both are readily replaceable in the field. Given the inherent tolerances in solid-state light sources, such as LEDs, the solid-state light sources in different light engine modules will typically require different drive data to achieve light with the defined characteristic(s). Storing the unique drive data for a given solid-state light source in the associated light engine memory of the light engine module allows the driver module to which the light engine module is ultimately connected to access and use the proper drive data to drive the solid-state light source of the light engine module.

For example, assume an original light engine module is replaced with a new light engine module in a lighting fixture. In this instance, the original driver module can access the new drive data from the light engine memory of the new light engine module and then use the new drive data to drive the solid-state light source of the new light engine module. If an original driver module is replaced with a new driver module in a lighting fixture, the new driver module can access the original drive data from the light engine memory of the original light engine module and then use the original drive data to drive the solid-state light source of the original light engine module.

In one embodiment, the driver module may have local memory and store the drive data that is accessed from the light engine memory of the light engine module in the local memory. During normal operation, the driver module will access the drive data from the local memory when determining how to drive the solid-state light source of the light engine module. The driver module may look at pairing data in the local memory or in the light engine memory to determine whether a different light engine module has been paired with the driver module and new drive data should be accessed from the light engine memory. Further, the light engine memory may also include light engine data, such as product information, identification information, and the like for the light engine module. The light engine data may be accessed, stored in local memory, and used by the driver module.

Prior to delving into the details of the present disclosure, an overview of an exemplary lighting fixture having readily replaceable lighting components is described. While the concepts of the present disclosure may be employed in any type of lighting system, the immediately following description describes these concepts in a troffer-type lighting fixture, such as the lighting fixture 10 illustrated in FIGS. 1-3. While the disclosed lighting fixture 10 employs an indirect lighting configuration wherein light is initially emitted upward from a light source and then reflected downward, direct lighting configurations may also take advantage of the concepts of the present disclosure. In addition to troffer-type lighting fixtures, the concepts of the present disclosure may also be employed in recessed lighting configurations, wall mount lighting configurations, outdoor lighting configurations, and the like. Reference is made to co-pending and co-assigned U.S. patent application Ser. No. 13/589,899 filed Aug. 20, 2013, Ser. No. 13/649,531 filed Oct. 11, 2012, and Ser. No. 13/606,713, now U.S. Pat. No. 8,829,800 filed Sep. 7, 2012, the contents of which are incorporated herein by reference. Further, any functionality or control techniques described below may be used to control different types of lighting fixtures, as well as different groups of the same or different types of lighting fixtures at the same time.

Figure 2:
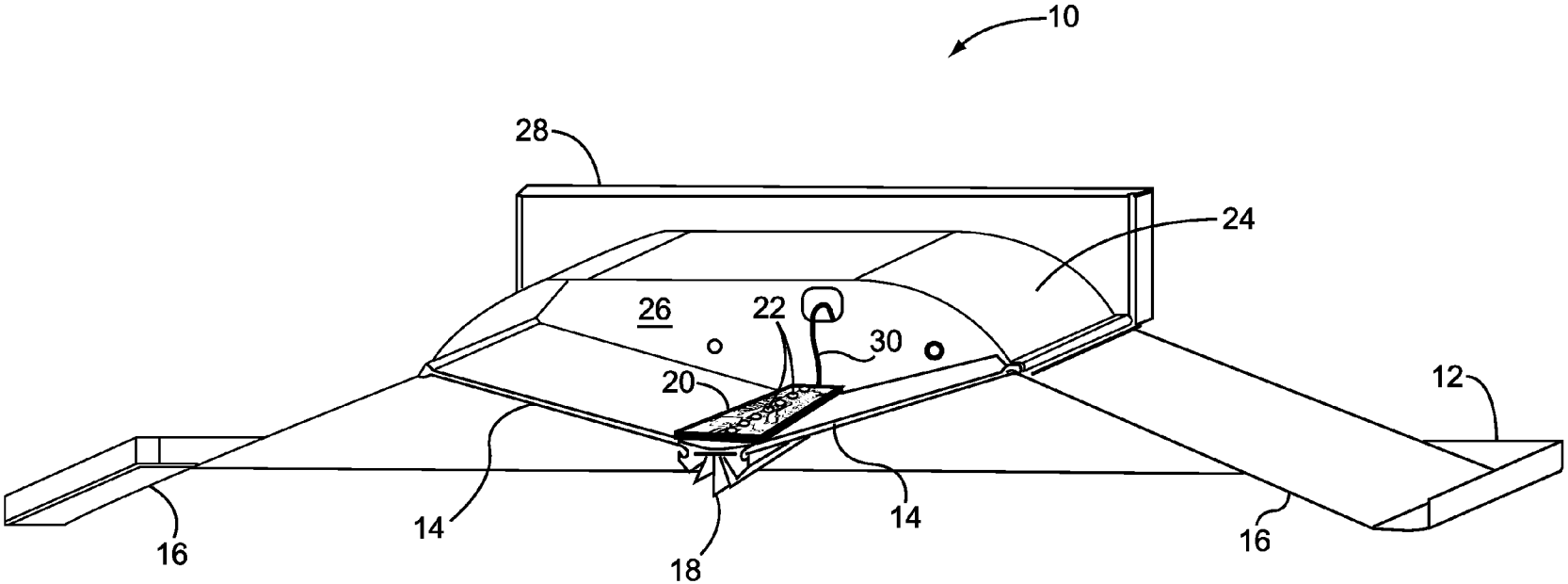
FIG. 2 is a cross-section of the lighting fixture of FIG. 1.
Figure 3:
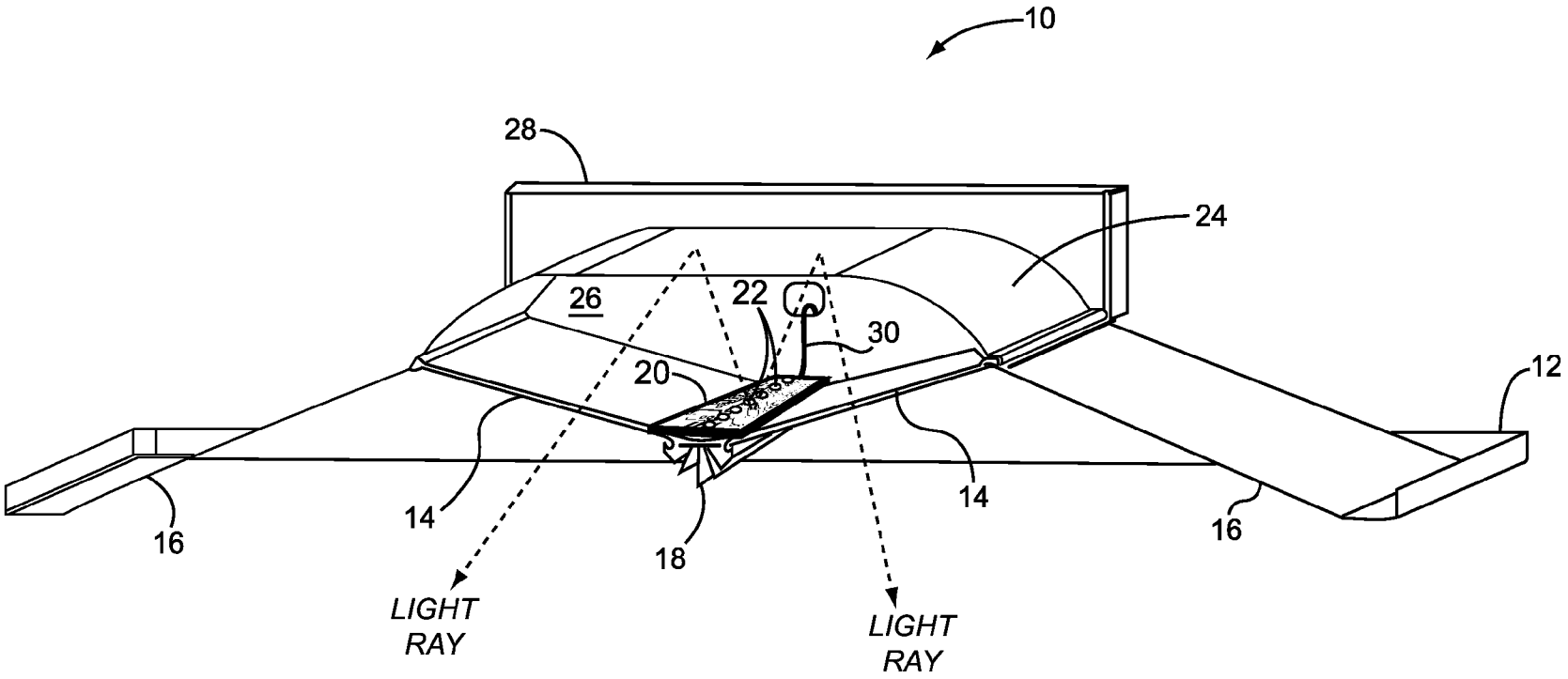
FIG. 3 is a cross-section of the lighting fixture of FIG. 1 illustrating how light emanates from the LEDs of the light engine and is reflected out through lenses of the lighting fixture.

In general, troffer-type lighting fixtures, such as the lighting fixture 10, are designed to mount in a ceiling. In most applications, the troffer-type lighting fixtures are mounted into a drop ceiling (not shown) of a commercial, educational, or governmental facility. As illustrated in FIGS. 1-3, the lighting fixture 10 includes a square or rectangular outer frame 12. In the central portion of the lighting fixture 10 are two rectangular lenses 14, which are generally transparent, translucent, or opaque. Reflectors 16 extend from the outer frame 12 to the outer edges of the lenses 14. The lenses 14 effectively extend between the innermost portions of the reflectors 16 to an elongated heat sink 18, which functions to join the two inside edges of the lenses 14.

Turning now to FIGS. 2 and 3 in particular, the back side of the heatsink 18 provides a mounting structure for a light engine module 20, which includes an LED array 22. The LED array 22 includes an array of individual LEDs mounted on an appropriate substrate, such as a printed circuit board substrate. The LEDs are oriented to primarily emit light upwards toward a concave cover 24. The volume bounded by the cover 24, the lenses 14, and the back of the heatsink 18 provides a mixing chamber 26. As such, light will emanate upwards from the LEDs of the LED array 22 toward the cover 24 and will be reflected downward through the respective lenses 14, as illustrated in FIG. 3. Notably, not all light rays emitted from the LED array 22 will reflect directly off of the bottom of the cover 24 and back through a particular lens 14 with a single reflection. Many of the light rays will bounce around within the mixing chamber 26 and effectively mix with other light rays, such that a desirably uniform light is emitted through the respective lenses 14.

Those skilled in the art will recognize that the type of lenses 14, the type of LEDs in the LED array 22, the shape of the cover 24, and any coating on the bottom side of the cover 24, among many other variables, will affect the quantity and quality of light emitted by the lighting fixture 10. As will be discussed in greater detail below, the LED array 22 may include LEDs of different colors, wherein the light emitted from the various LEDs mixes together to form light of any desired color and quality. For the following examples, assume that the light emitted is a white light having a desired color temperature and quality based on the design parameters for the particular application.

As is apparent from FIGS. 2 and 3, the elongated fins of the heatsink 18 may be visible from the bottom of the lighting fixture 10. Placing the LEDs of the LED array 22 in thermal contact along the upper side of the heatsink 18 allows any heat generated by the LEDs to be effectively transferred to the elongated fins on the bottom side of the heatsink 18 for dissipation within the room in which the lighting fixture 10 is mounted. Again, the particular configuration of the lighting fixture 10 illustrated in FIGS. 1-3 is merely one of the virtually limitless configurations for lighting fixtures 10 in which the concepts of the present disclosure are applicable.

Figure 4:
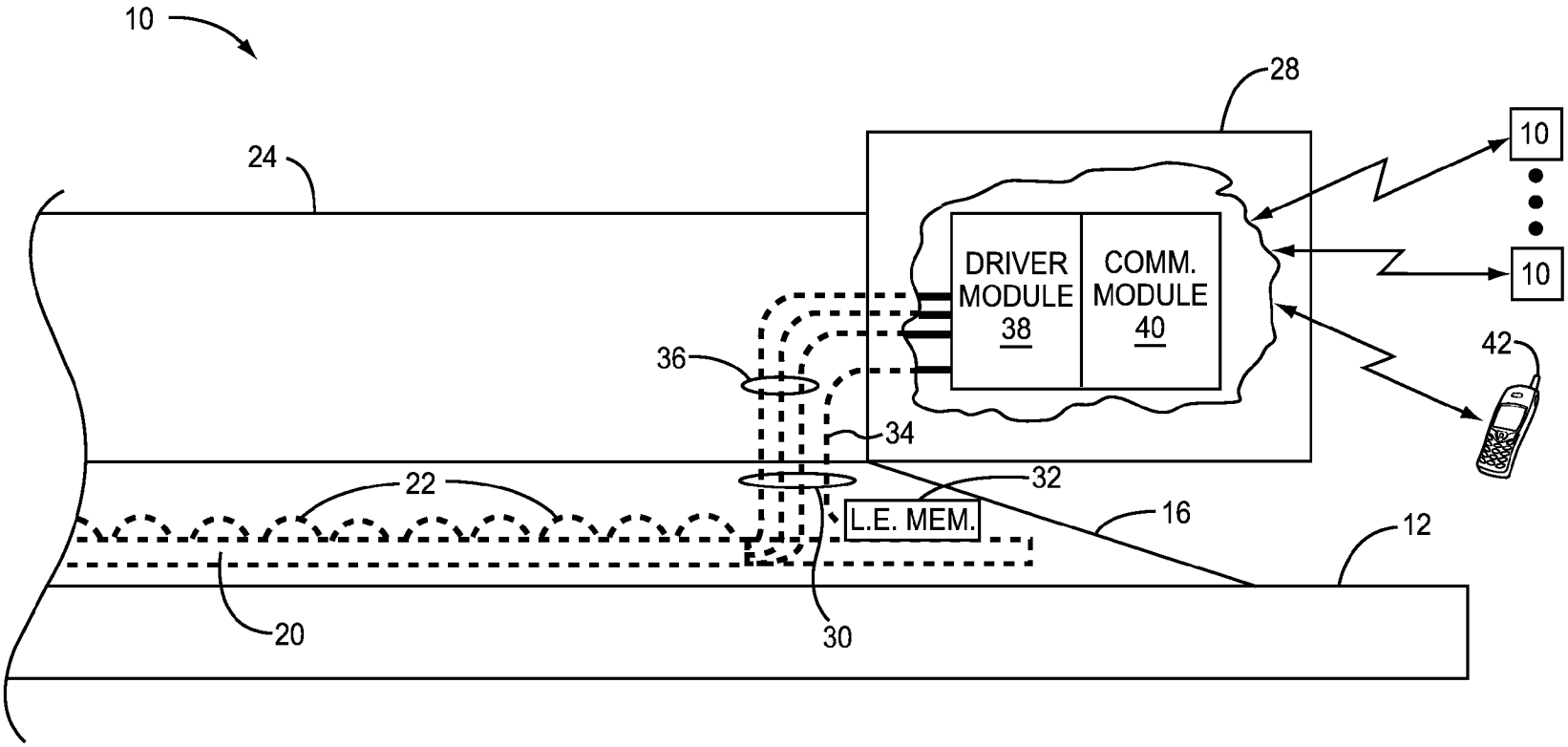
FIG. 4 illustrates a communication module and a driver module, which is used to drive the light engine, within an electronics housing of the lighting fixture of FIG. 1.

With continued reference to FIGS. 2 and 3, an electronics housing 28 is shown mounted at one end of the lighting fixture 10, and is used to house at least a portion of the electronics used to power and control the LED array 22 of the light engine module 20. These electronics are coupled to the light engine module 20 through appropriate cabling 30. As shown in FIG. 4, the light engine module may have its own memory, which is referred to as a light engine memory 32, in addition to the LED array 22 and other passive or active components. The cabling 30 may be broken into digital cabling 34 and drive signal cabling 36, which will be described below.

Continuing with reference to FIG. 4, the electronics provided in the electronics housing 28 are generally divided into a driver module 38 and a communications module 40. At a high level, the driver module 38 is coupled to the LED array 22 through the cabling 30 and directly drives the LEDs of the LED array 22 via the drive signal cabling 36 based on control information provided by itself or by the communications module 40. In one embodiment, the driver module 38 provides the intelligence for the lighting fixture 10 and is capable of driving the LEDs of the LED array 22 in a desired fashion. The driver module 38 is able to store information in and read information from the light engine memory 32, which is located on the light engine module 20, via the digital cabling 34. The light engine memory 32 typically includes at least some non-volatile memory. The driver module 38 may be provided on a single integrated module or may be divided into two or more sub-modules depending the desires of the designer.

The communications module 40 may act as an intelligent communication interface that facilitates communications between the driver module 38 and other lighting fixtures 10, a remote control system (not shown), or a portable handheld commissioning tool, which may also be configured to communicate with a remote control system in a wired or wireless fashion. The commissioning tool is referred to herein as a commissioning tool 42, which may be used for a variety of functions, including changing parameters in the lighting fixture 10, commissioning a lighting network, and the like. As noted above, these communications may include the sharing of sensor data, instructions, and any other data between the various lighting fixtures 10 in the lighting network. In essence, the communications module 40 functions to coordinate the sharing of intelligence and data among the lighting fixtures 10.

In the embodiment of FIG. 4, the communications module 40 may be implemented on a separate printed circuit board (PCB) than the driver module 38. The respective PCBs of the driver module 38 and the communications module 40 may be configured to allow the connector of the communications module 40 to plug into the connector of the driver module 38, wherein the communications module 40 is mechanically mounted or affixed to the driver module 38 once the connector of the communications module 40 is plugged into the mating connector of the driver module 38. A similar arrangement may be provided for the light engine module 20 and the driver module 38.

In other embodiments, a cable may be used to connect the respective connectors of the driver module 38 and the communications module 40, other attachment mechanisms may be used to physically couple the communications module 40 to the driver module 38, or the driver module 38 and the communications module 40 may be separately affixed to the inside of the electronics housing 28. In such embodiments, the interior of the electronics housing 28 is sized appropriately to accommodate both the driver module 38 and the communications module 40. In many instances, the electronics housing 28 provides a plenum rated enclosure for both the driver module 38 and the communications module 40.

Figure 5:
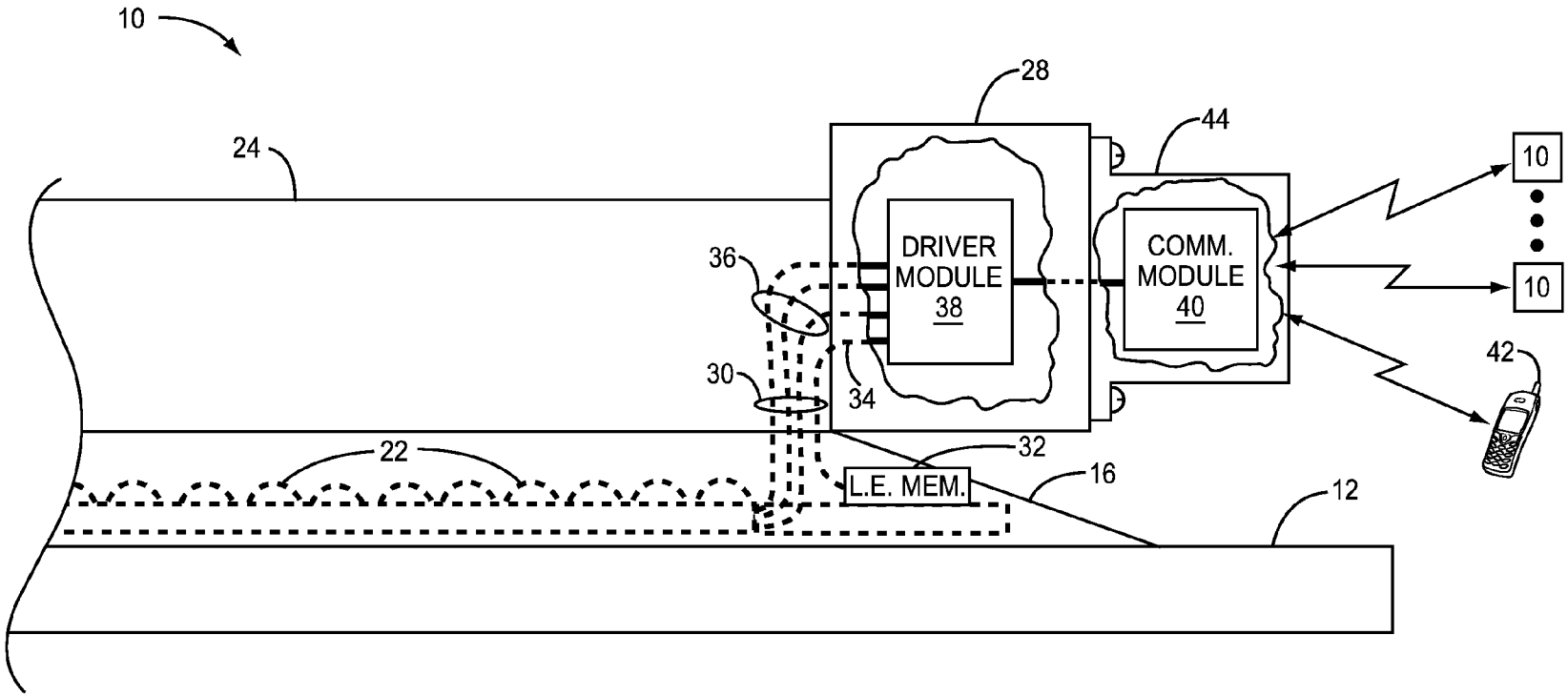
FIG. 5 illustrates a driver module provided in an electronics housing of the lighting fixture of FIG. 1 and a communications module in an associated housing coupled to the exterior of the electronics housing according to one embodiment of the disclosure.

With the embodiment of FIG. 4, adding or replacing the communications module 40 requires gaining access to the interior of the electronics housing 28. If this is undesirable, the driver module 38 may be provided alone in the electronics housing 28. The communications module 40 may be mounted outside of the electronics housing 28 in an exposed fashion or within a supplemental housing 44, which may be directly or indirectly coupled to the outside of the electronics housing 28, as shown in FIG. 5. The supplemental housing 44 may be bolted to the electronics housing 28. The supplemental housing 44 may alternatively be connected to the electronics housing snap-fit or hook-and-snap mechanisms. The supplemental housing 44, alone or when coupled to the exterior surface of the electronics housing 28, may provide a plenum rated enclosure.

In embodiments where the electronics housing 28 and the supplemental housing 44 will be mounted within a plenum rated enclosure, the supplemental housing 44 may not need to be plenum rated. Further, the communications module 40 may be directly mounted to the exterior of the electronics housing 28 without any need for a supplemental housing 44, depending on the nature of the electronics provided in the communications module 40, how and where the lighting fixture 10 will be mounted, and the like. The latter embodiment wherein the communications module 40 is mounted outside of the electronics housing 28 may prove beneficial when the communications module 40 facilitates wireless communications with the other lighting fixtures 10, the remote control system, or other network or auxiliary device.

In essence, the driver module 38 may be provided in the plenum rated electronics housing 28, which may not be conducive to wireless communications. The communications module 40 may be mounted outside of the electronics housing 28 by itself or within the supplemental housing 44 that is more conducive to wireless communications. A cable may be provided between the driver module 38 and the communications module 40 according to a defined communication interface.

The embodiments that employ mounting the communications module 40 outside of the electronics housing 28 may be somewhat less cost effective, but provide significant flexibility in allowing the communications module 40 or other auxiliary devices to be added to the lighting fixture 10, serviced, or replaced. The supplemental housing 44 for the communications module 40 may be made of a plenum rated plastic or metal, and may be configured to readily mount to the electronics housing 28 through snaps, screws, bolts, or the like, as well as receive the communications module 40. The communications module 40 may be mounted to the inside of the supplemental housing 44 through snap-fits, screws, twistlocks, and the like. The cabling and connectors used for connecting the communications module 40 to the driver module 38 may take any available form, such as with standard category 5/6 (cat 5/6) cable having RJ45 connectors, edge card connectors, blind mate connector pairs, terminal blocks and individual wires, and the like. Having an externally mounted communications module 40 relative to the electronics housing 28 that includes the driver module 38 allows for easy field installation of different types of communications modules 40 for a given driver module 38.

Figure 6:
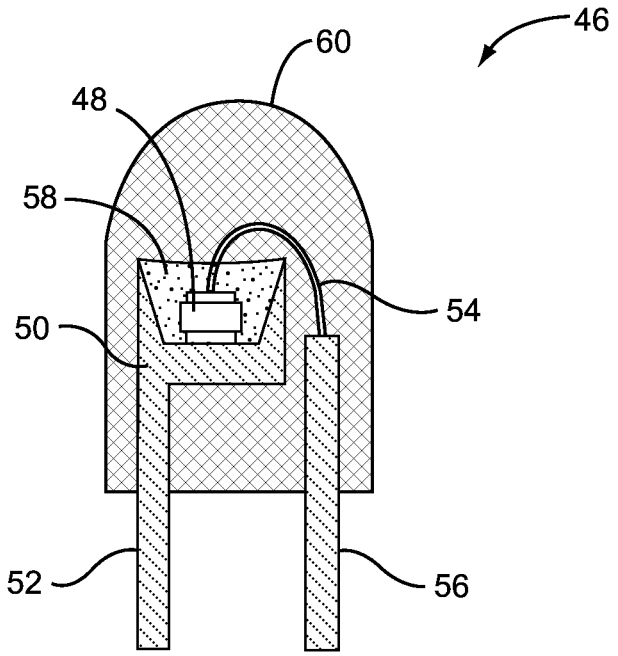
FIG. 6 is a cross-section of an exemplary LED according to a first embodiment of the disclosure.
Figure 7:
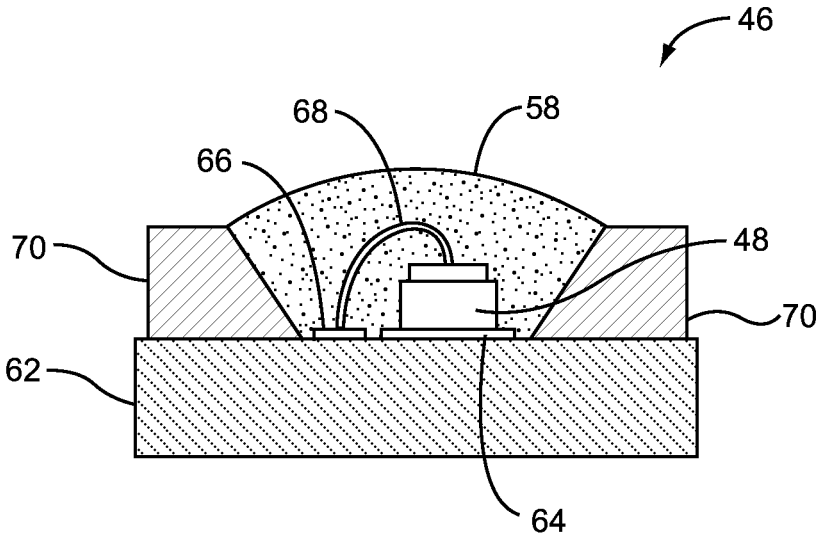
FIG. 7 is a cross-section of an exemplary LED according to a second embodiment of the disclosure.

A description of an exemplary embodiment of the light engine module 20, driver module 38, and the communications module 40 follows. As noted, the light engine module 20 includes an LED array 22. Exemplary configurations for LEDs 46 of the LED array 22 are illustrated in FIGS. 6 and 7. With reference to FIG. 6, a single LED chip 48 is mounted on a reflective cup 50 using solder or a conductive epoxy, such that ohmic contacts for the cathode (or anode) of the LED chip 48 are electrically coupled to the bottom of the reflective cup 50. The reflective cup 50 is either coupled to or integrally formed with a first lead 52 of the LED 46. One or more bond wires 54 connect ohmic contacts for the anode (or cathode) of the LED chip 48 to a second lead 56.

The reflective cup 50 may be filled with an encapsulant material 58 that encapsulates the LED chip 48. The encapsulant material 58 may be clear or contain a wavelength conversion material, such as a phosphor, which is described in greater detail below. The entire assembly is encapsulated in a clear protective resin 60, which may be molded in the shape of a lens to control the light emitted from the LED chip 48.

An alternative package for an LED 46 is illustrated in FIG. 7 wherein the LED chip 48 is mounted on a substrate 62. In particular, the ohmic contacts for the anode (or cathode) of the LED chip 48 are directly mounted to first contact pads 64 on the surface of the substrate 62. The ohmic contacts for the cathode (or anode) of the LED chip 48 are connected to second contact pads 66, which are also on the surface of the substrate 62, using bond wires 68. The LED chip 48 resides in a cavity of a reflector structure 70, which is formed from a reflective material and functions to reflect light emitted from the LED chip 48 through the opening formed by the reflector structure 70. The cavity formed by the reflector structure 70 may be filled with an encapsulant material 58 that encapsulates the LED chip 48. The encapsulant material 58 may be clear or contain a wavelength conversion material, such as a phosphor.

In either of the embodiments of FIGS. 6 and 7, if the encapsulant material 58 is clear, the light emitted by the LED chip 48 passes through the encapsulant material 58 and the protective resin 60 (FIG. 6) without any substantial shift in color. As such, the light emitted from the LED chip 48 is effectively the light emitted from the LED 46. If the encapsulant material 58 contains a wavelength conversion material, substantially all or a portion of the light emitted by the LED chip 48 in a first wavelength range may be absorbed by the wavelength conversion material, which will responsively emit light in a second wavelength range. The concentration and type of wavelength conversion material will dictate how much of the light emitted by the LED chip 48 is absorbed by the wavelength conversion material as well as the extent of the wavelength conversion. In embodiments where some of the light emitted by the LED chip 48 passes through the wavelength conversion material without being absorbed, the light passing through the wavelength conversion material will mix with the light emitted by the wavelength conversion material. Thus, when a wavelength conversion material is used, the light emitted from the LED 46 is shifted in color from the actual light emitted from the LED chip 48.

For example, the LED array 22 may include a group of blue-shifted yellow (BSY) or blue-shifted green (BSG) LEDs 46 as well as a group of red LEDs 46. BSY LEDs 46 include an LED chip 48 that emits bluish light, and the wavelength conversion material is a yellow phosphor that absorbs the blue light and emits yellowish light. Even if some of the bluish light passes through the phosphor, the resultant mix of light emitted from the overall BSY LED 46 is yellowish light. The yellowish light emitted from a BSY LED 46 has a color point that falls above the Black Body Locus (BBL) on the 1931 CIE chromaticity diagram wherein the BBL corresponds to the various color temperatures of white light.

Similarly, BSG LEDs 46 include an LED chip 48 that emits bluish light; however, the wavelength conversion material is a greenish phosphor that absorbs the blue light and emits greenish light. Even if some of the bluish light passes through the phosphor, the resultant mix of light emitted from the overall BSG LED 46 is greenish light. The greenish light emitted from a BSG LED 46 has a color point that falls above the BBL on the 1931 CIE chromaticity diagram wherein the BBL corresponds to the various color temperatures of white light.

The red LEDs 46 generally emit reddish light at a color point on the opposite side of the BBL as the yellowish or greenish light of the BSY or BSG LEDs 46. As such, the reddish light from the red LEDs 46 mixes with the yellowish or greenish light emitted from the BSY or BSG LEDs 46 to generate white light that has a desired color temperature and falls within a desired proximity of the BBL. In effect, the reddish light from the red LEDs 46 pulls the yellowish or greenish light from the BSY or BSG LEDs 46 to a desired color point on or near the BBL. Notably, the red LEDs 46 may have LED chips 48 that natively emit reddish light wherein no wavelength conversion material is employed. Alternatively, the LED chips 48 may be associated with a wavelength conversion material, wherein the resultant light emitted from the wavelength conversion material and any light that is emitted from the LED chips 48 without being absorbed by the wavelength conversion material mixes to form the desired reddish light.

The blue LED chip 48 used to form either the BSY or BSG LEDs 46 may be formed from a gallium nitride (GaN), indium gallium nitride (InGaN), silicon carbide (SiC), zinc selenide (ZnSe), or like material system. The red LED chip 48 may be formed from an aluminum indium gallium nitride (AlInGaP), gallium phosphide (GaP), aluminum gallium arsenide (AlGaAs), or like material system. Exemplary yellow phosphors include cerium-doped yttrium aluminum garnet (YAG:Ce), yellow BOSE (Ba, O, Sr, Si, Eu) phosphors, and the like. Exemplary green phosphors include green BOSE phosphors, Lutetium aluminum garnet (LuAg), cerium doped LuAg (LuAg:Ce), Maui M535 from Lightscape Materials, Inc. of 201 Washington Road, Princeton, N.J. 08540, and the like. The above LED architectures, phosphors, and material systems are merely exemplary and are not intended to provide an exhaustive listing of architectures, phosphors, and materials systems that are applicable to the concepts disclosed herein.

Figure 8:
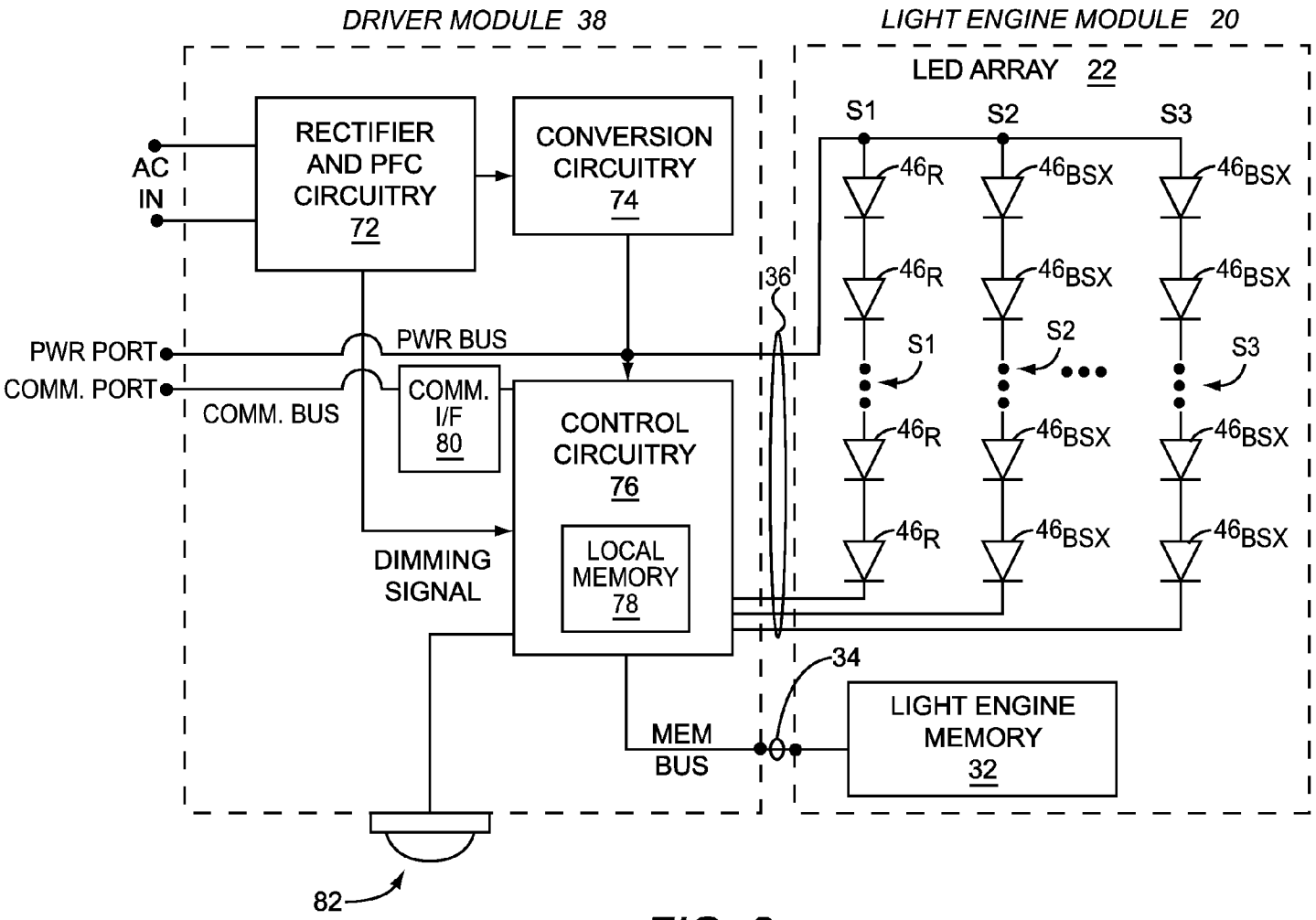
FIG. 8 is a schematic of a driver module and an LED array according to one embodiment of the disclosure.

As noted, the LED array 22 of the light engine module 20 may include a mixture of LEDs 46 of different colors, such as a combination of red LEDs 46 and either BSY or BSG LEDs 46. The driver module 38 for driving the LED array 22 is illustrated in FIG. 8 according to one embodiment of the disclosure. The LED array 22 may be electrically divided into one or more strings of series connected LEDs 46. As depicted, there are three LED strings S1, S2, and S3. For clarity, the reference number "46" will include a subscript indicative of the color of the LED 46 in the following text where 'R' corresponds to red, 'BSY' corresponds to blue shifted yellow, 'BSG' corresponds to blue shifted green, and 'BSX' corresponds to either BSG or BSY LEDs. LED string S1 includes a number of red LEDs $\mathbf{46}_R$, LED string S2 includes a number of either BSY or BSG LEDs $\mathbf{46}_{BSX}$, and LED string S3 includes a number of either BSY or BSG LEDs $\mathbf{46}_{BSX}$. The driver module 38 controls the current delivered to the respective LED strings S1, S2, and S3. The current used to drive the LEDs 46 is generally pulse width modulated (PWM), wherein the duty cycle of the pulsed current controls the intensity of the light emitted from the LEDs 46.

The BSY or BSG LEDs $\mathbf{46}_{BSX}$ in the second LED string S2 may be selected to have a slightly more bluish hue (less yellowish or greenish hue) than the BSY or BSG LEDs $\mathbf{46}_{BSX}$ in the third LED string S3. As such, the current flowing through the second and third strings S2 and S3 may be tuned to control the yellowish or greenish light that is effectively emitted by the BSY or BSG LEDs $\mathbf{46}_{BSX}$ of the second and third LED strings S2, S3. By controlling the relative intensities of the yellowish or greenish light emitted from the differently hued BSY or BSG LEDs $\mathbf{46}_{BSX}$ of the second and third LED strings S2, S3, the hue of the combined yellowish or greenish light from the second and third LED strings S2, S3 may be controlled in a desired fashion.

The ratio of current provided through the red LEDs $\mathbf{46}_R$ of the first LED string S1 relative to the currents provided through the BSY or BSG LEDs $\mathbf{46}_{BSX}$ of the second and third LED strings S2 and S3 may be adjusted to effectively control the relative intensities of the reddish light emitted from the red LEDs $\mathbf{46}_R$ and the combined yellowish or greenish light emitted from the various BSY or BSG LEDs $\mathbf{46}_{BSX}$. As such, the intensity and the color point of the yellowish or greenish light from BSY or BSG LEDs $\mathbf{46}_{BSX}$ can be set relative to the intensity of the reddish light emitted from the red LEDs $\mathbf{46}_R$. The resultant yellowish or greenish light mixes with the reddish light to generate white light that has a desired color temperature and falls within a desired proximity of the BBL.

Notably, the number of LED strings Sx may vary from one to many and different combinations of LED colors may be used in the different strings, as well as in each individual string. Each LED string Sx may have LEDs 46 of the same color, variations of the same color, or substantially different colors, such as red, green, and blue. In one embodiment, a single LED string may be used, wherein the LEDs in the string are all substantially identical in color, vary in substantially the same color, or include different colors. In such an embodiment, shunt or bypass circuitry may be provided to selectively route the drive currents around one or more LEDs in the string. The drive currents may be redirected using a pulse width modulated control signal to control the contribution of light from the bypassable LEDs. In another embodiment, three LED strings Sx with red, green, and blue LEDs may be used, wherein each LED string Sx is dedicated to a single color. In yet another embodiment, at least two LED strings Sx may be used, wherein different colored BSY LEDs are used in one of the LED strings Sx and red LEDs are used in the other of the LED strings Sx. As noted above, the various control methods for any of the strings and LED configurations provide effective control of the overall intensity, color, color temperature, and the like.

With reference to FIG. 8, schematic diagrams of an exemplary driver module 38 and light engine module 20 are depicted for an exemplary embodiment. The driver module 38 generally includes rectifier and power factor correction (PFC) circuitry 72, conversion circuitry 74, and control circuitry 76, which will include a central processing unit (not shown) and local memory 78. The adjective "local" is used primary to identify the local memory 78 as being resident virtually anywhere on the driver module 38.

The rectifier and power factor correction circuitry 72 is adapted to receive an AC power signal (AC IN), rectify the AC power signal, and correct the power factor of the AC power signal. The resultant signal is provided to the conversion circuitry 74, which converts the rectified AC power signal to a DC power signal. The DC power signal may be boosted (increased) or bucked (reduced) to one or more desired DC voltages by DC-DC converter circuitry, which is provided by the conversion circuitry 74. Internally, The DC power signal may be used to power the control circuitry 76 and any other circuitry provided in the driver module 38.

The DC power signal is also provided to a power bus (PWR BUS), which is coupled to one or more power ports (PWR PORT), which may be part of the standard communication interface. The DC power signal provided to the power bus may be used to provide power to one or more external devices that are coupled to the power bus and separate form the driver module 38. These external devices may include the communications module 40 and any number of auxiliary devices, which are discussed further below. Accordingly, these external devices may rely on the driver module 38 for power and can be efficiently and cost effectively designed accordingly. The rectifier and PFC circuitry 72 and the conversion circuitry 74 of the driver module 38 are robustly designed in anticipation of being required to supply power to not only the internal circuitry of the driver module 38, but also to supply power to these external devices as well. Such a design greatly simplifies the power supply design, if not eliminating the need for a power supply, and reduces the cost for these external devices.

As illustrated, the DC power signal may also be provided to another port, which will be connected by the drive signal cabling 36 to the LED array 22 of the light engine module 20. In this embodiment, the supply line of the DC power signal is effectively coupled to the first end of each of the LED strings S1, S2, and S3 in the LED array 22. The control circuitry 76 is coupled to the second end of each of the LED strings S1, S2, and S3 by the drive signal cabling 36. Based on any number of fixed or dynamic parameters, the control circuitry 76 may individually control the pulse width modulated current that flows through the respective LED strings S1, S2, and S3 such that the resultant white light emitted from the LED strings S1, S2, and S3 has a desired color temperature and falls within a desired proximity of the BBL. Notably, the architecture used to drive the LED array 22 in this embodiment is merely exemplary, as those skilled in the art will recognize other architectures for controlling the drive voltages and currents presented to the LED strings S1, S2, and S3. Further, virtually any color of light may be desired and provided by the LED array 22.

In certain instances, a dimming device controls the AC power signal. The rectifier and PFC circuitry 72 may be configured to detect the relative amount of dimming associated with the AC power signal and provide a corresponding dimming signal to the control circuitry 76. Based on the dimming signal, the control circuitry 76 will adjust the current provided to each of the LED strings S1, S2, and S3 to effectively reduce the intensity of the resultant white light emitted from the LED strings S1, S2, and S3 while maintaining the desired color temperature.

The intensity or color of the light emitted from the LEDs 46 may be affected by ambient temperature. If associated with a thermistor (not shown) or other temperature-sensing device, the control circuitry 76 can control the current provided to each of the LED strings S1, S2, and S3 based on ambient temperature in an effort to compensate for adverse temperature effects. The intensity or color of the light emitted from the LEDs 46 may also change over time. If associated with an LED light sensor $S_L$ (not shown), the control circuitry 76 can measure the color of the resultant white light being generated by the LED strings S1, S2, and S3 and adjust the current provided to each of the LED strings S1, S2, and S3 to ensure that the resultant white light maintains a desired color temperature or other desired metric. The control circuitry 76 may also monitor the output of any occupancy, ambient light, or like sensors (not shown) for occupancy, ambient light, or like information and turn on, turn off, or otherwise control the current provided to each of the LED strings S1, S2, and S3 as desired based on the sensor information.

The control circuitry 76 may bidirectionally communicate with the communications module 40 or other devices over a communication bus (COMM BUS) through an appropriate communication interface (I/F) 80 using a defined protocol. The control circuitry 76 may receive instructions from the communications module 40 or other device and take appropriate action to implement the received instructions. The instructions may range from controlling how the LEDs 46 of the LED array 22 are driven to returning operational data, such as temperature, occupancy, light output, or ambient light information, that was collected by the control circuitry 76 to the communications module 40 or other device via the communication bus (COMM BUS). For example, dimming instructions may be delivered from the communications module 40 or other device to the control circuitry 76 in the form of a command via the communication bus (COMM BUS) via the communication interface 80. The control circuitry 76 may process the instructions and control the drive current to the LED strings S1, S2, and S3 to achieve an appropriate dimming level. Notably, the functionality of the communications module 40 may be integrated into the driver module 38, and vice versa.

With continued reference to FIG. 8, the light engine module 20 includes light engine memory 32, which may be mounted on the same PCB as the LEDs 46 of the LED array 22. The control circuitry 76 on the driver module 38 is effectively coupled to the light engine memory 32 on the light engine module 20 via the digital cabling 34. In one embodiment, the control circuitry 76 can read data from and write data to all, or at least a portion of, the light engine memory 32 via digital cabling 34 and a memory bus (MEM BUS), which may also support the local memory 78 and any other memory on the driver module 38.

The driver module 38 may also include a user interface, such as the push button 82, which is coupled to the control circuitry 76. The user interface allows a user to physically provide information, such a commands, to the control circuitry 76. The user interface could also include a display or dedicated LED (not shown) to provide feedback to the user. Feedback may be provided back to the user via the LED array 22 in the form of flashing, turning on or off, and the like. Further, the user interface could be provided on the light engine module 20.

Figure 9A:
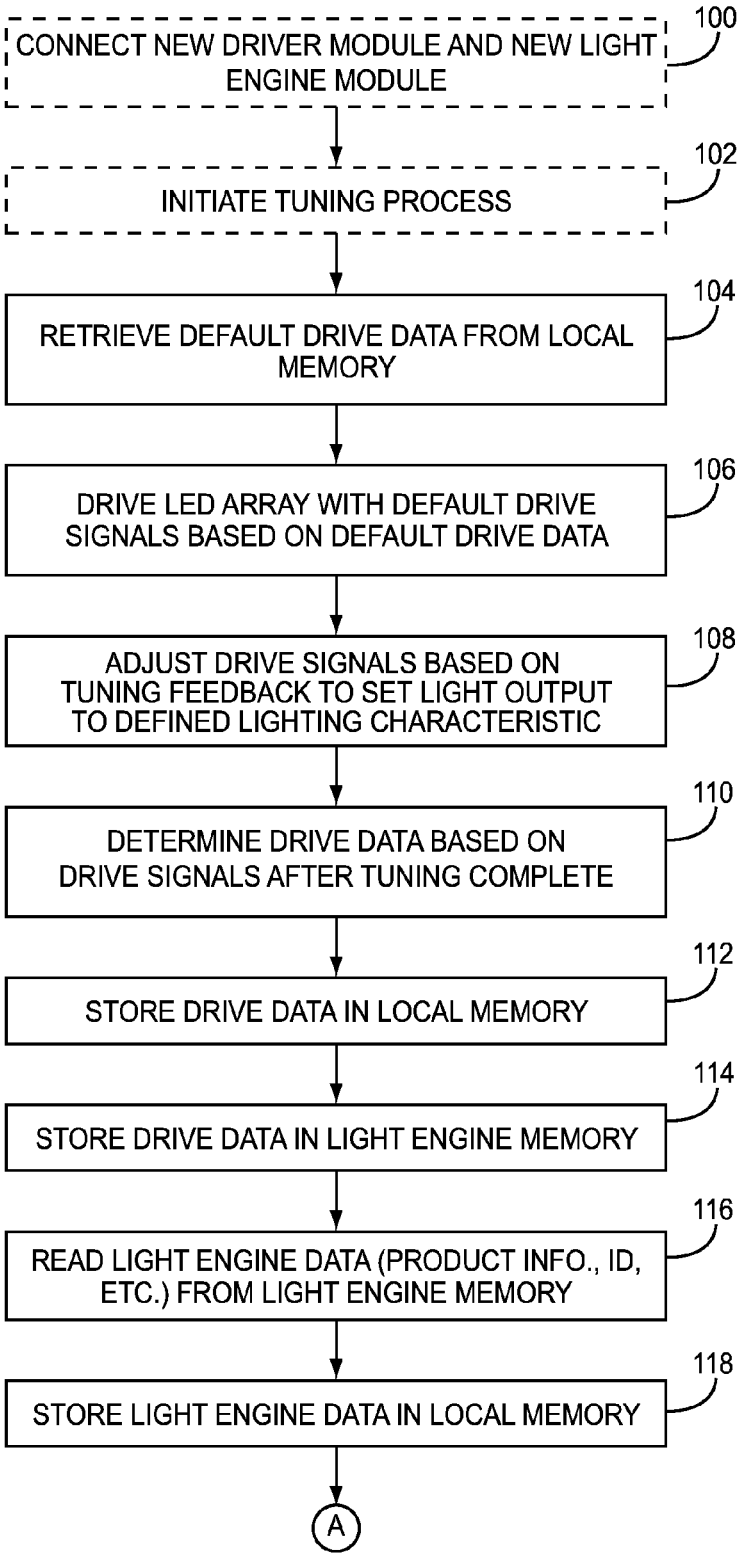
FIGS. 9A and 9B are a flow diagram illustrating an exemplary process for pairing a driver module with a light engine according to one embodiment of the disclosure.
Figure 9B:
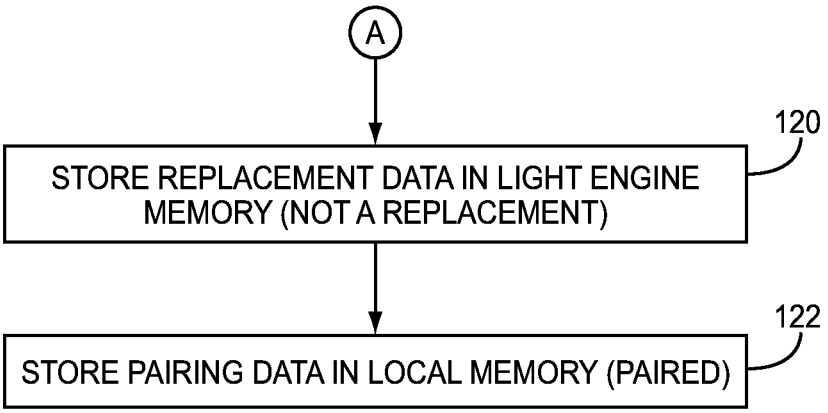

With reference to FIGS. 9A and 9B, an exemplary process for configuring a lighting fixture 10 with a driver module 38 and a light engine module 20 is provided. This process represents a part of the initial manufacturing process, wherein the driver module 38 and the light engine module 20 are initially paired with one another as the lighting fixture 10 is being constructed. At this point, a new driver module 38 and a new light engine module 20 are connected (step 100) and a tuning process is initiated (step 102). In this example, the local memory 78 of the driver module 38 may include default drive data. The driver module 38 will retrieve the default drive data from the local memory 78 (step 104) and then drive the LED array 22 of the light engine module 20 based on the default drive data (step 106).

The default drive data is designed to cause the LED array 22 to produce light that is close to one or more defined lighting characteristics, such as intensity (or brightness), color, color temperature, and the like. The light provided by the LED array 22 is analyzed by an external test fixture, which may provide tuning feedback to the driver module 38. Based on the tuning feedback, the driver module 38 will adjust the drive signals provided to the various strings in the LED array 22 until the light provided by the LED array 22 meets the defined lighting characteristics, which are required for the lighting fixture 10 (step 108). For example, the drive signals may represent the current levels, voltage levels, waveform characteristics, or the like for the signals used to drive LED strings S1, S2, and S3. Either the driver module 38 or the external test fixture will determine the appropriate drive data based on the drive signals that were required to achieve the defined lighting characteristics for the light output after tuning is complete (step 110). The driver module 38 will store the drive data in its local memory 78 (step 112) as well as store the drive data in the light engine memory 32 on the light engine module 20 (step 114).

The light engine memory 32 may also include light engine data, such as product information, identification information, and the like, that is associated with the light engine module 20. The driver module 38 may read the light engine data from the light engine memory 32 (step 116) and store the light engine data in the local memory 78 of the driver module 38 (step 118).

At this point, the driver module 38 may store replacement data in the light engine memory 32, wherein the replacement data indicates that the light engine module 20 is not a replacement (step 120), but is instead an original light engine module 20 for the lighting fixture 10. The driver module 38 will also recognize that it is now paired with the light engine module 20, and as such, will store pairing data in its local memory 78 to indicate that it has been paired with a light engine module 20, and in certain embodiments, indicate the specific light engine module 20 with which it has been paired (step 122).

From the above, the replacement data that is stored in the light engine memory 32 is used by the driver module 38 to determine whether the attached light engine module 20 is one that has already been associated with the driver module 38, or is a replacement. A replacement light engine module 20 will come from the factory with replacement data that indicates the light engine module 20 is a replacement in the light engine memory 32. The light engine memory 32 will also include the requisite drive data for the light engine module 20. Thus, when the light engine module 20 is connected to the driver module 38 in the lighting fixture 10, the driver module 38 can look at the replacement data to determine that a replacement light engine module 20 has been installed, and then retrieve the new drive data for the replacement light engine module 20 from the light engine memory 32. The new drive data may be stored in the local memory 78 of the driver module 38, which will use the new drive data to drive the LED array 22 of the light engine module 20. The drive data may include the actual drive signal characteristics, such as the current levels, voltage levels, or waveform characteristics. In another embodiment, the drive data may simply provide information that corresponds to the requisite signal characteristics. In the latter example, the control circuitry 76 of the driver module 38 will be able to use the drive data to set the drive signal characteristics. For example, the local memory 78 may include a look-up table that matches the drive data to a drive current level for all of the LED strings Sx, or for each of the LED strings Sx.

The pairing data that is stored in the local memory 78 of the driver module 38 simply indicates that the driver module 38 has been paired with a light engine module 20. Once the driver module 38 is paired with a light engine module 20, the pairing data in the local memory 78 will indicate that there has been a pairing. For a replacement driver module 38 that has not yet been paired with a light engine module 20, the pairing data will indicate that the driver module 38 is not yet paired. Once a replacement driver module 38 is placed in a lighting fixture 10 and coupled to a light engine module 20, the driver module 38 will change the pairing data from indicating that it has yet to be paired with a light engine module 20 to indicating that it has been paired with a light engine module 20.

Figure 10:
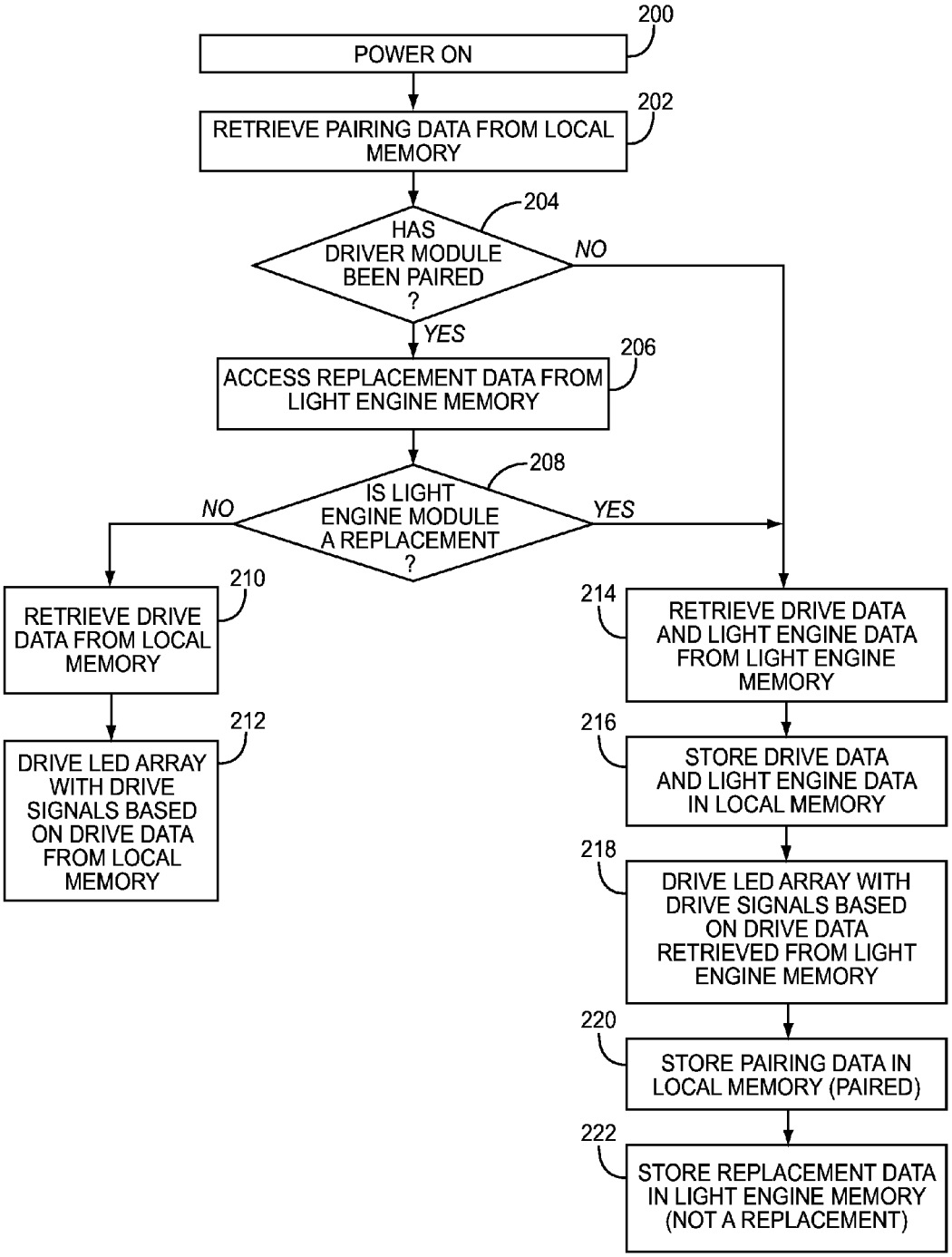
FIG. 10 illustrates an exemplary process for replacing either a driver module or a light engine of a lighting fixture according to a first embodiment of the disclosure.

The flow diagram of FIG. 10 illustrates the operation of a driver module 38. This process illustrates how a driver module 38 will power on during normal operation. During this power on sequence, the driver module 38 will determine whether it is a replacement driver module 38, if it has been connected to a replacement light engine module 20, or if it remains paired with an original light engine module 20. Initially, the driver module 38 powers on (step 200) and retrieves the pairing data from local memory 78 (step 202). If the pairing data indicates that the driver module 38 has already been paired with a light engine module 20 (step 204), the driver module 38 will access the replacement data from the light engine memory 32 of the light engine module 20 (step 206). If the replacement data indicates that the light engine module 20 is not a replacement (step 208), the driver module 38 will retrieve the drive data from the local memory 78 (step 210) and proceed to drive the LED array 22 of the light engine module 20 with drive signals based on the drive data from its local memory 78 (step 212).

If the pairing data indicates that the driver module 38 has not been paired with a light engine module 20 (step 204) or if the replacement data indicates that the light engine module 20 is a replacement (step 208), the driver module 38 will retrieve new drive data and light engine data from the light engine memory 32 of the light engine module 20. For a situation where the pairing data indicates that the driver module 38 has not been paired, this indicates that the driver module 38 is a replacement driver module 38, and thus, new drive data for the light engine module 20 to which the replacement driver module 38 is now connected is needed. For the second situation where the replacement data indicates that the light engine module 20 is a replacement light engine module 20, the original driver module 38 will need the new drive data for the replacement light engine module 20.

Once the drive data and the light engine data from the light engine memory 32 are retrieved (step 214), the driver module 38 will store the drive data and the light engine data in its local memory 78 (step 216). At this point, the driver module 38 can drive the LED array 22 with drive signals based on the drive data retrieved from the light engine memory 32 (step 218). The driver module 38 now stores pairing data in the local memory 78 (step 220) to indicate that it is now paired with either the original light engine module 20, if the driver module 38 was a replacement, or a replacement light engine module 20, if the driver module 38 was an original. Similarly, the driver module 38 can store replacement data in the light engine memory 32 indicating that the light engine module 20 is no longer a replacement, and thus has been paired with the driver module 38 (step 222).

As an alternative to using pairing data or replacement data to figure out if one of the driver module 38 or the light engine module 20 has been replaced, the driver module 38 may simply compare the drive data or the light engine data that is stored locally with that which is stored in the light engine memory 32. Further, both the pairing data and the replacement data may be configured as a single bit, which is either set or reset based on the relative pairing or replacement status. The driver module 38 may initially power on and drive the LED array 22 with drive signals that are based on whatever drive data it has in local memory 78, and then check for the need to pull drive data from the light engine memory 32, if there has been a replacement of the light engine module 20 or a new installation of the driver module 38. The driver module 38 can then transition from the drive data that was stored in local memory 78 to that which was retrieved from the light engine memory 32.

Figure 11:
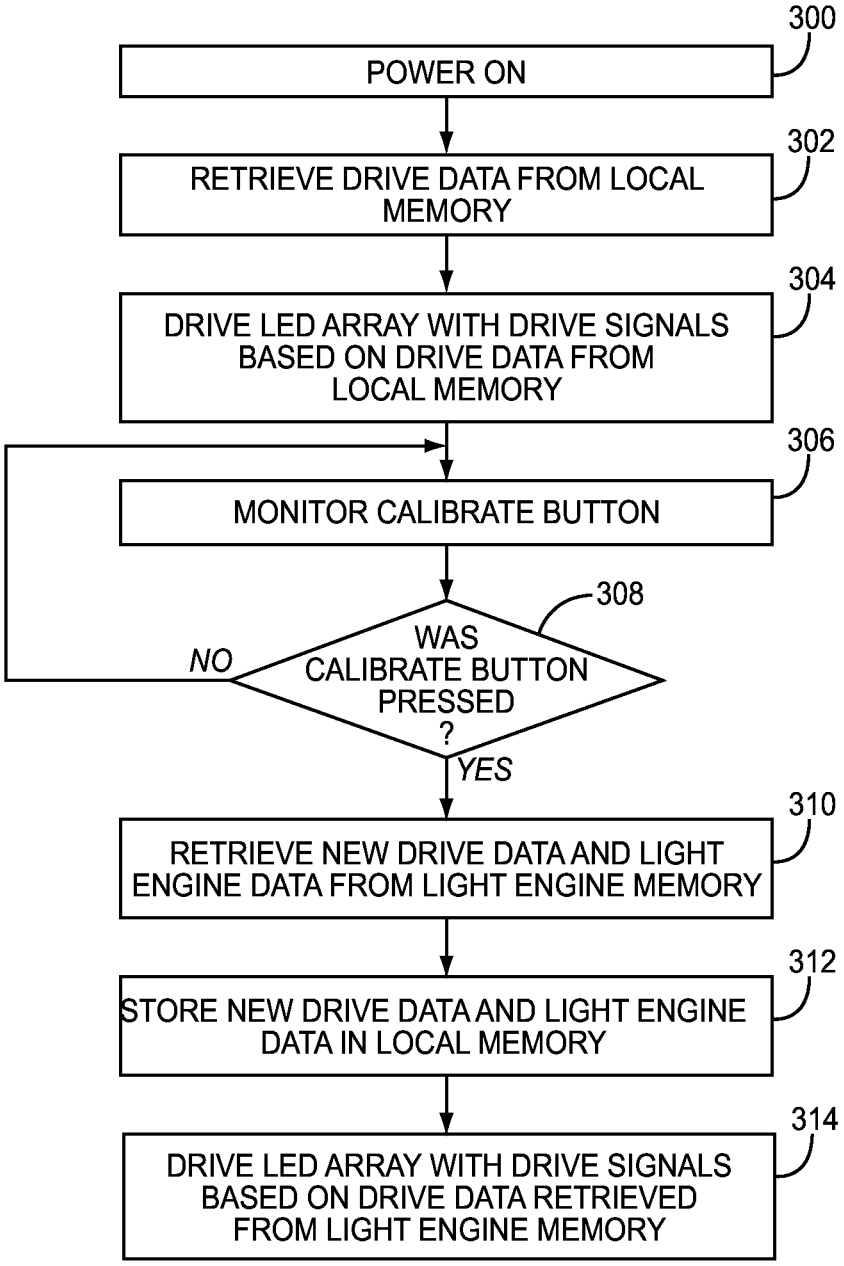
FIG. 11 illustrates an exemplary process for replacing either a driver module or a light engine of a lighting fixture according to a second embodiment of the disclosure.

In the prior example, the driver module 38 and the light engine module 20 are configured to allow for automatic detection of replacement of either the driver module 38 or the light engine module 20. In the following embodiment, the driver module 38 is configured with a calibrate button, which will take the form of the user interface 82. In essence, if the calibrate button 82 is pressed, the driver module 38 will retrieve new drive data, and perhaps light engine data, from the light engine memory 32 of whatever light engine module 20 is currently coupled to the driver module 38. An exemplary process is illustrated in the flow diagram of FIG. 11.

Initially, the driver module 38 will power on (step 300) and retrieve drive data from the local memory 78 (step 302). The driver module 38 will then drive the LED array 22 with drive signals based on the drive data obtained from the local memory 78 (step 304). The driver module 38 will also monitor the calibrate button (step 306). When the calibrate button is pressed (step 308), the driver module 38 will retrieve new drive data and light engine data from the light engine memory 32 of the light engine module 20 (step 310) and store the new drive data and light engine data in local memory 78 of the driver module 38 (step 312). The driver module 38 can then transition to driving the LED array 22 with drive signals that are based on the drive data retrieved from the light engine memory 32 (step 314).

In this embodiment, whenever a driver module 38 or a light engine module 20 is replaced in a lighting fixture 10, the user can simply press the calibrate button 82 and the driver module 38, whether it is an original or a replacement, will obtain the drive data from the light engine memory 32 of the light engine module 20, whether it is a replacement or an original, store the drive data, and then drive the LED array 22 based on the appropriate drive data for the light engine module 20. In either of these embodiments, storing the drive data in the light engine memory 32, which is integrated with the light engine module 20, allows the interchangeability of driver modules 38 and light engine modules 20. In essence, the light engine modules 20 carry with them the requisite drive data, and any driver module 38 that is attached to that particular light engine module 20 can access the drive data and then use it to drive the LED array 22 of the light engine module 20.

Figure 12:
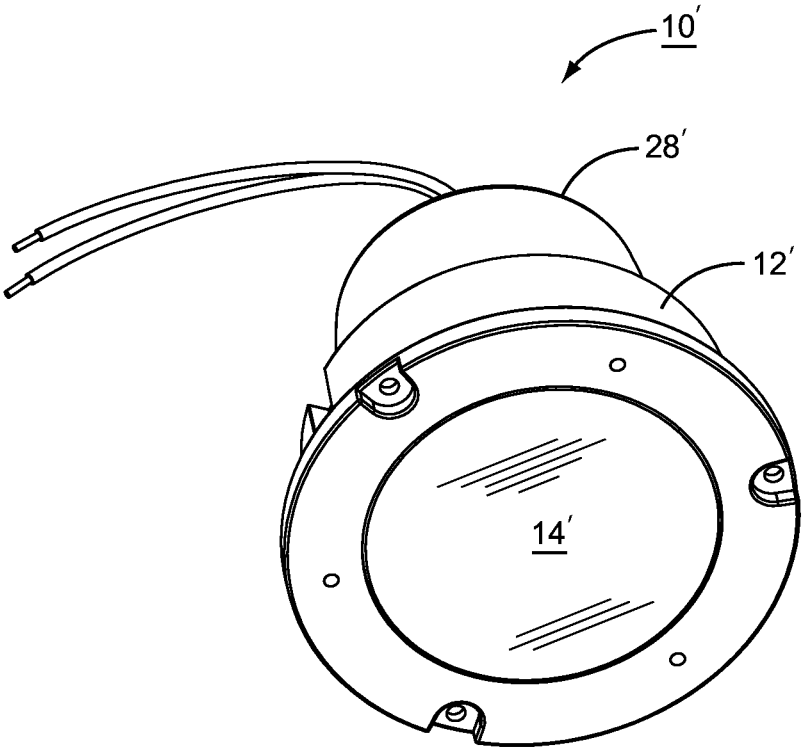
FIG. 12 is a perspective view of an alternative lighting fixture according to another embodiment of the disclosure.

While the embodiments described above were focused on a troffer-type lighting fixture 10, the concepts disclosed herein apply to any type of lighting fixture. For example, a recessed-type lighting fixture 10' as illustrated in FIG. 12 may also incorporate all of the concepts described above. As illustrated, the lighting fixture 10' includes a main housing 12', a lens 14', and an electronics housing 28'. The various modules described above may be housed within the electronics housing 28' or attached thereto, outside of or within supplemental plenum rated enclosures. These configurations will vary based on the particular application. However, the concepts of a modular system that allows any of the modules to be readily replaced and new modules to be added are considered to be within the scope of the present disclosure and the claims that follow.

Those skilled in the art will recognize improvements and modifications to the embodiments of the present disclosure. All such improvements and modifications are considered within the scope of the concepts disclosed herein and the claims that follow.

What is claimed is:

1. A driver module of a lighting fixture for coupling to a separate light engine module, the separate light engine module being a replacement for a prior light engine module of the lighting fixture and having a solid-state light source and light engine memory, the driver module comprising:

a local memory; and a control circuitry associated with the local memory and adapted to:

retrieve replacement data from the light engine memory;

retrieve drive data from the light engine memory of a light engine module when the replacement data indicates that the separate light engine module of the lighting fixture is the replacement for the prior light engine module of the lighting fixture, wherein drive signals configured to control how the driver module drives the solid-state light source to generate light with at least one lighting characteristic are derived from the drive data;

drive the solid-state light source of the separate light engine module based on the drive data; and set the replacement data in the light engine memory to indicate that the replacement light engine module is no longer a replacement for the prior light engine module of the lighting fixture.

2. The driver module of claim 1 wherein the control circuitry is further adapted to store the drive data in the local memory upon retrieving it from the light engine memory and access the drive data from the local memory for driving the solid-state light source.

3. The driver module of claim 2 wherein the control circuitry is further adapted to retrieve light engine data from the light engine memory and store the light engine data in the local memory.

4. The driver module of claim 3 wherein the light engine data comprises at least one of product information and identification information for the light engine module.

5. The driver module of claim 1 wherein the local memory stores pairing information indicative of whether the driver module has been paired with the separate light engine module and prior to retrieving the drive data from the light engine memory, the control circuitry is further adapted to retrieve the pairing information from the local memory and then retrieve the drive data when the pairing information indicates that the driver module is a replacement driver module.

6. The driver module of claim 5 wherein when the drive data is retrieved from the light engine memory, the control circuitry is further adapted to set the pairing information to indicate that the driver module is paired with the light engine module.

7. The driver module of claim 1 further comprising a user interface coupled to the control circuitry and wherein the control circuitry retrieves the drive data from the light engine memory upon receiving an input from the user interface.

8. The driver module of claim 7 wherein the user interface is a push button and the input corresponds to a user pressing the push button.

9. The driver module of claim 1 wherein the solid-state light source is an LED-based light source.

10. The driver module of claim 9 wherein the LED-based light source comprises a plurality of LEDs such that at least a first of the plurality of LEDs emits light of a first color, and at least a second of the plurality of LEDs emits light of a second color that is different than the first color.

11. The driver module of claim 9 wherein the LED-based light source comprises at least one LED string in which each of the at least one of the LED strings comprises a plurality of LEDs.

12. The driver module of claim 1 wherein the driver module is a replacement driver module for the lighting fixture comprising the light engine module.

13. The driver module of claim 1 wherein the driver module is an original driver module provided in the lighting fixture comprising the light engine module.

14. The driver module of claim 1 wherein the control circuitry is configured to:

compare drive data in the local memory and the light engine memory; and store the drive data retrieved from the light engine memory as new drive data such that the new drive data that was retrieved from the light engine memory drives the solid-state light source.

15. A light engine module of a lighting fixture for coupling to a separate driver module of the lighting fixture, the light engine module comprising:

a mounting structure;

a solid-state light source mounted on the mounting structure; and a light engine memory mounted on the mounting structure and accessible by the driver module once the driver module is electrically coupled to the light engine module, the light engine memory comprising:

drive data where drive signals configured to control how the driver module drives the solid-state light source to generate light with at least one lighting characteristic are derived from the drive data; and replacement data that indicates whether or not the light engine module is a replacement light engine module for the lighting fixture, wherein the replacement data is configured to be modified by the driver module such that the replacement data is modified to indicate that the replacement light engine module is no longer the replacement light engine module of the lighting fixture.

16. The light engine module of claim 15 wherein the solid-state light source is an LED-based light source.

17. The light engine module of claim 16 wherein the LED-based light source comprises a plurality of LEDs such that at least a first of the plurality of LEDs emits light of a first color, and at least a second of the plurality of LEDs emits light of a second color that is different than the first color.

18. The light engine module of claim 16 wherein the LED-based light source comprises at least one LED string in which each of the at least one of the LED strings comprises a plurality of LEDs.

19. The light engine module of claim 15 wherein the light engine memory further comprises light engine data that provides at least one of product information and identification information for the light engine module.

20. The light engine module of claim 15 wherein the mounting structure is a printed circuit board to which the driver module can be electrically coupled.

21. A lighting fixture comprising:

a location for a light engine module having a solid-state light source and light engine memory; and a driver module comprising:

a local memory; and a control circuitry associated with the local memory and adapted to:

retrieve replacement data from the light engine memory;

retrieve drive data from the light engine memory of the light engine module when the replacement data indicates that the light engine module attached at the location is a replacement of another light engine module previously attached at the location, wherein drive signals configured to control how the driver module drives the solid-state light source to generate light with at least one lighting characteristic are derived from the drive data;

drive the solid-state light source of the light engine module based on the drive data; and set the replacement data in the light engine memory to indicate that the replacement light engine module is no longer a replacement for the prior light engine module of the lighting fixture.

22. The lighting fixture of claim 21 wherein the light engine module is separate from the driver module and is attached at the location, the light engine module comprising:

the solid-state light source; and the light engine memory that is accessible by the driver module once the driver module is electrically coupled to the light engine module.

23. A replacement driver module for a lighting fixture that comprises a separate light engine module with a solid-state light source and light engine memory, the replacement driver module comprising:

a local memory that stores pairing information indicative of whether the replacement driver module has been paired with the separate light engine module; and a control circuitry associated with the local memory and adapted to:

retrieve the pairing information from the local memory;

retrieve drive data from the light engine memory when the pairing information indicates that the replacement driver module is a replacement driver module of another driver module of the lighting fixture, wherein drive signals configured to control how the replacement driver module drives the solid-state light source to generate light with at least one lighting characteristic are derived from the drive data;

modify replacement data in the light engine memory when the light engine memory replacement data indicates the separate light engine module is a replacement, wherein the replacement data is modified to no longer identify the separate light engine module as a replacement light engine module; and drive the solid-state light source of the light engine module based on the drive data.

24. The replacement driver module of claim 23 wherein when the drive data is retrieved from the light engine memory, the control circuitry is further adapted to set the pairing information to indicate that the replacement driver module is paired with the light engine module.

25. The replacement driver module of claim 23 wherein the control circuitry is configured to:

compare drive data in the local memory and the light engine memory; and store the drive data retrieved from the light engine memory as new drive data such that the new drive data that was retrieved from the light engine memory drives the solid-state light source.

* * * * *